US012326309B2

(12) United States Patent
Popp et al.

(10) Patent No.: US 12,326,309 B2
(45) Date of Patent: Jun. 10, 2025

(54) TRIGGER RELOCATION ASSEMBLY FOR MODERN SPORTING FIREARM

(71) Applicant: Colton Ray Popp, Rice, MN (US)

(72) Inventors: Colton Ray Popp, Rice, MN (US); Jacob William Bump, North Branch, MN (US); Duane G. Plumski, Sartell, MN (US); Tylor Lenz, Rice, MN (US); Nicholas Cotton, Duluth, MN (US); Andrew Wensman, Sartell, MN (US)

( * ) Notice: Subject to any disclaimer, the term of this patent is extended or adjusted under 35 U.S.C. 154(b) by 0 days.

(21) Appl. No.: 18/229,897

(22) Filed: Aug. 3, 2023

(65) Prior Publication Data

US 2024/0077270 A1 Mar. 7, 2024

Related U.S. Application Data

(60) Provisional application No. 63/404,003, filed on Sep. 6, 2022.

(51) Int. Cl.
*F41A 19/09* (2006.01)
*F41A 19/10* (2006.01)

(52) U.S. Cl.
CPC ..... *F41A 19/09* (2013.01); *F41A 19/10* (2013.01)

(58) Field of Classification Search
CPC ..... F41A 19/09; F41A 19/10
USPC ..... 42/69.01, 69.02; 89/27.11, 136
See application file for complete search history.

(56) References Cited

U.S. PATENT DOCUMENTS

| | | | | |
|---|---|---|---|---|
| 4,463,654 | A | 8/1984 | Barnes et al. | |
| 4,601,123 | A | 7/1986 | Swearengen et al. | |
| 4,677,781 | A * | 7/1987 | Lee | F41A 17/22 42/72 |
| 7,356,958 | B2 | 4/2008 | Weir | |
| 7,661,220 | B2 | 2/2010 | Crandall et al. | |
| 8,782,940 | B1 | 7/2014 | Morris | |
| 8,931,393 | B1 * | 1/2015 | Vincent | F41A 17/46 89/27.3 |
| 9,109,856 | B1 | 8/2015 | Zamlinsky | |
| 9,347,725 | B2 | 5/2016 | McAlister | |
| 9,677,846 | B1 | 6/2017 | Vankeuren, III | |
| 10,288,369 | B2 | 5/2019 | Albury | |
| 10,337,813 | B2 | 7/2019 | Jonsson | |
| 11,644,260 | B1 * | 5/2023 | Douvier | F41A 11/02 42/75.01 |
| 2011/0283582 | A1 | 11/2011 | Hunter et al. | |
| 2013/0185975 | A1 | 7/2013 | Johnson | |
| 2014/0075803 | A1 | 3/2014 | Muller | |
| 2014/0075812 | A1 | 3/2014 | Johnson | |
| 2014/0360076 | A1 | 12/2014 | Zamlinsky | |
| 2017/0131051 | A1 | 5/2017 | Albury | |
| 2018/0292157 | A1 * | 10/2018 | Niswander | F41A 19/06 |

* cited by examiner

*Primary Examiner* — Bret Hayes
(74) *Attorney, Agent, or Firm* — Daniel J. Polglaze; Westman, Champlin & Koehler, P.A.

(57) ABSTRACT

A trigger relocation assembly for a modern sporting firearm includes a frame enclosing a trigger of the modern sporting firearm, an assembly trigger within the frame, the assembly trigger positioned forward of the trigger, an asymmetrical transfer bar coupled to transfer movement of the assembly trigger one-to-one to the trigger, and a plurality of bushings. The bushings are configured to guide the transfer bar within the frame.

13 Claims, 10 Drawing Sheets

TRIGGER RELOCATION ASSEMBLY FOR MODERN SPORTING FIREARM

CROSS-REFERENCE TO RELATED APPLICATION(S)

This application claims the benefit of U.S. provisional application No. 63/404,003, filed on Sep. 6, 2022, the content of which is hereby incorporated by reference in its entirety.

SUMMARY

A trigger relocation assembly for a modern sporting firearm includes a frame enclosing a trigger of the modern sporting firearm, an assembly trigger within the frame, the assembly trigger positioned forward of the trigger, an asymmetrical transfer bar coupled to transfer movement of the assembly trigger one-to-one to the trigger, and a plurality of bushings. The bushings are configured to guide the transfer bar within the frame.

A modular assembly for a modern sporting firearm includes a trigger relocation assembly removably attachable to the modern sporting firearm without functional alteration of the modern sporting firearm. The trigger relocation assembly includes a frame enclosing a trigger of the modern sporting firearm, and an assembly trigger within the frame. The assembly trigger is positioned forward of the trigger. An asymmetrical transfer bar is coupled to transfer movement of the assembly trigger one-to-one to the trigger.

A method of reversibly converting a modern sporting rifle between a standard configuration and a bullpup configuration includes providing a frame attachable to the modern sporting rifle with a mounting block, mounting the frame to the mounting block and to the modern sporting rifle, and providing a trigger assembly for the frame using an asymmetrical transfer bar to provide one-to-one correspondence between a trigger of the trigger assembly and a trigger of the modern sporting firearm.

This summary is not intended to describe each disclosed embodiment or every implementation of trigger relocation assemblies as described herein. Many other novel advantages, features, and relationships will become apparent as this description proceeds. The figures and the description that follow more particularly exemplify illustrative embodiments.

DETAILED DESCRIPTION OF ILLUSTRATIVE EMBODIMENTS

Figure 1:
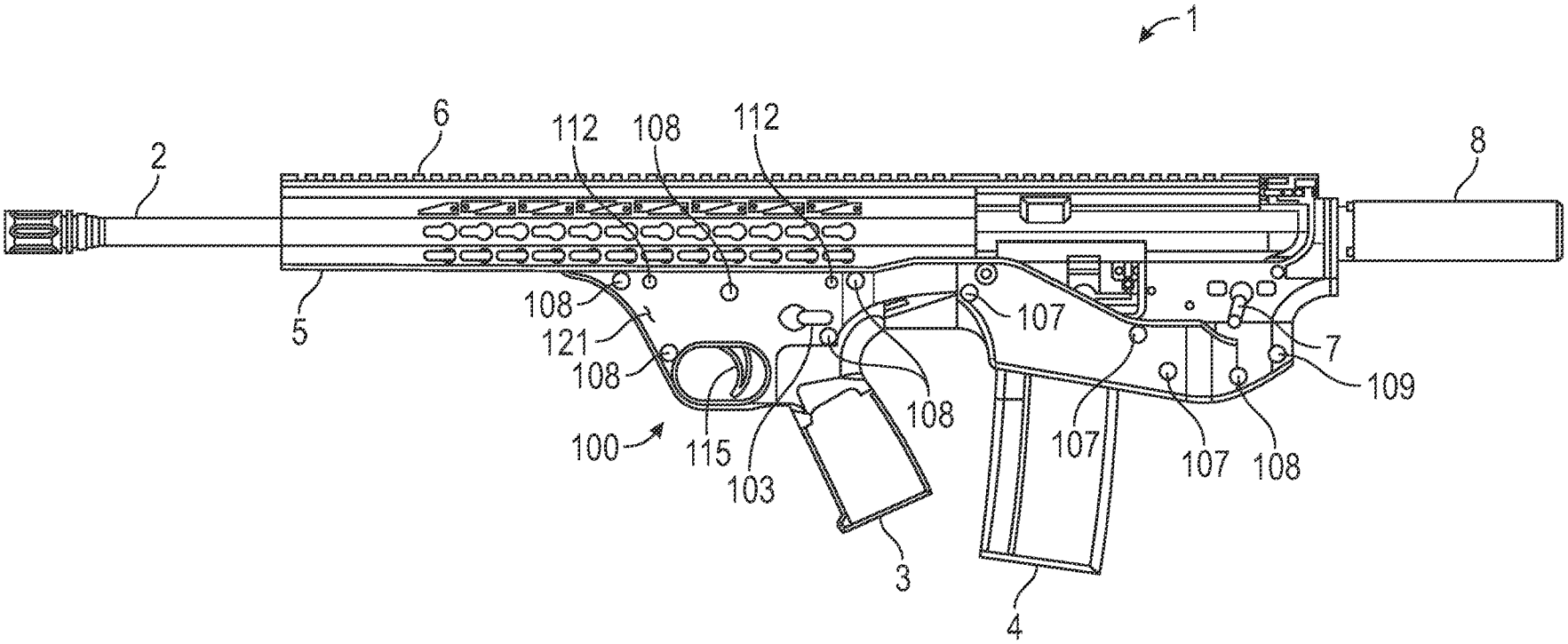
FIG. 1 is a side elevation view of a modern sporting rifle and a trigger relocation assembly according to an embodiment of the present disclosure mounted thereon.

In general, embodiments of the present disclosure provide a trigger relocation assembly for a modern sporting firearm. The embodiments allow for conversion to and from a "bullpup" configuration of the modern sporting firearm. The embodiments of the assembly allow for transferring a modern sporting firearm trigger location to a forward location to improve ergonomics for activities such as hunting.

The embodiments generally provide an assembly comprising a frame that surrounds the existing trigger of the firearm, mounts to the firearm, and relocates the trigger to a position forward of the magazine and action of the firearm, while leaving the firearm alone from a perspective of modification aside from changing a stock/grip. The firearm is readily and easily convertible between its original configuration and the configuration with the relocated trigger. A secondary safety is provided in one embodiment. An asymmetrical linkage between the trigger of the trigger relocation assembly and the original trigger of the firearm is also provided. A bias force is provided in one embodiment to counter trigger weight due to the transfer linkage mass and any friction forces therein in the event of an impact force from the rear of the modern sporting rifle.

The embodiments of the present disclosure are generally configured for a modern sporting firearm. It should be understood that different materials, forms, fitments, and the like may be used without departing from the scope of the disclosure.

It should be noted that the same reference numerals are used in different figures for same or similar elements. It should also be understood that the terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps, and do not supply a serial or numerical limitation on the elements or steps of the embodiments thereof. For example, "first," "second," and "third" elements or steps need not necessarily appear in that order, and the embodiments thereof need not necessarily be limited to three elements or steps. It should also be understood that, unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. It should also be understood that the singular forms of "a," "an," and "the" include plural references unless the context clearly dictates otherwise.

Referring to FIG. 1, a portion of a modern sporting firearm 1 with a trigger relocation assembly 100 for the modern sporting firearm 1. Modern sporting firearm 1 comprises in one embodiment a barrel 2, grip 3, magazine 4, lower receiver 5, upper receiver 6, safety mechanism 7, and stock attachment 8. As seen in side elevation in FIG. 1, the trigger relocation assembly 100 includes a frame half 121 (mated to a frame half 120 as shown in other FIGS. herein), a trigger 115, takedown pins 112, a safety 103, and fasteners 107, 108, and 109 for mounting the frame half 121 to its counterpart and to the modern sporting firearm 1. Opening 109 is used to mount the assembly at its rear to the location on the firearm 1 where a grip is originally positioned on the firearm 1.

Figure 2:
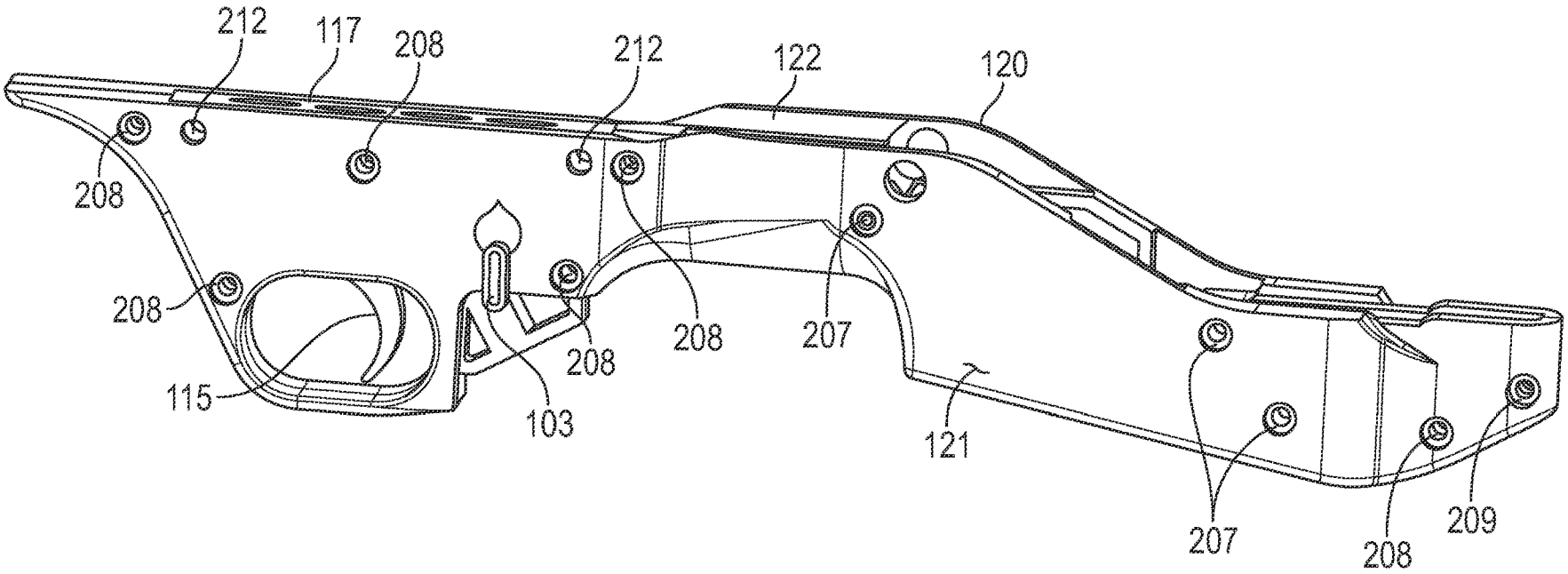
FIG. 2 is a left side perspective view of a trigger relocation assembly according to an embodiment of the present disclosure.
Figure 3:
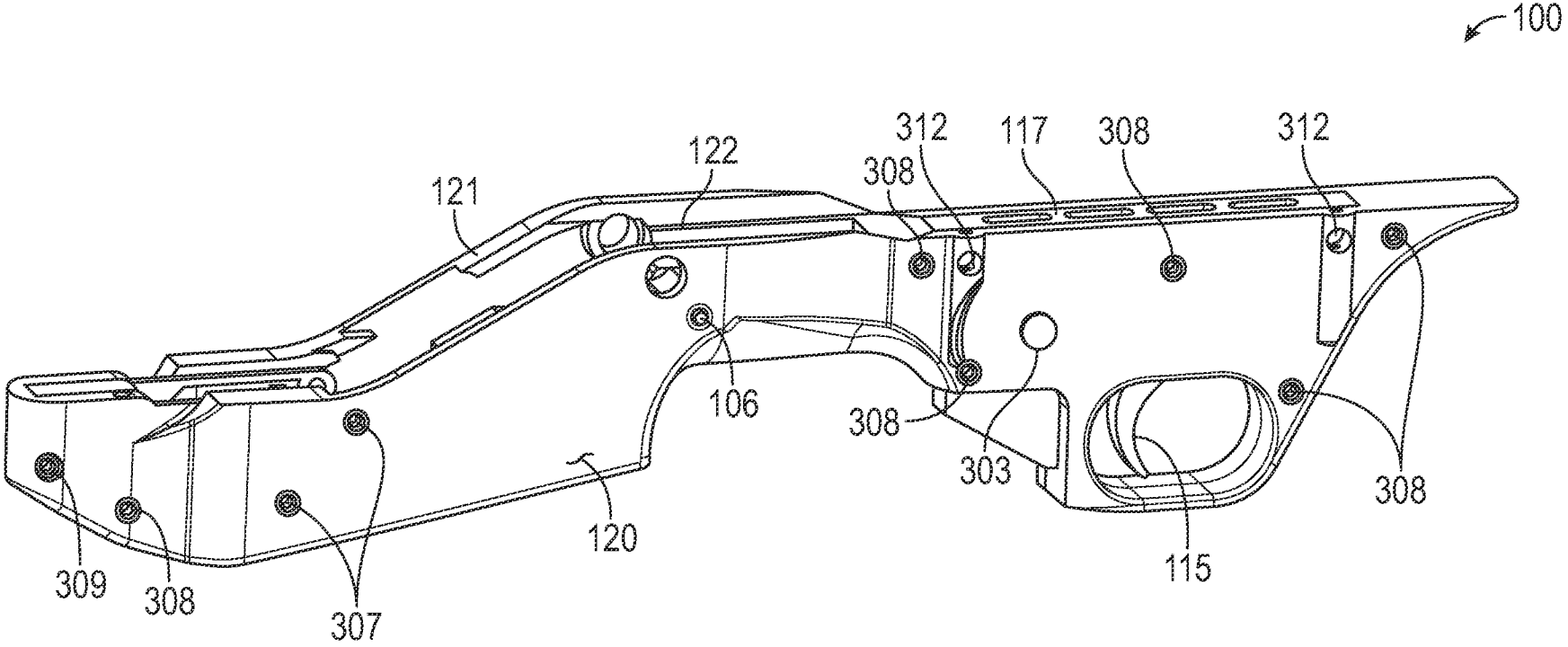
FIG. 3 is a right side perspective view of the trigger relocation assembly of FIG. 2.

The trigger relocation assembly 100 is shown in greater detail in left perspective (FIG. 2), right perspective (FIG. 3), and exploded (FIG. 6) views. Frame halves 120 and 121 are shown in greater detail in FIGS. 4 and 5, respectively. Referring to FIGS. 2-3, an embodiment of the trigger relocation assembly 100 is shown in left perspective and right perspective views, respectively. The assembly 100 does not replace or move the original trigger of firearm 1. Instead, a transfer bar (see FIGS. 4-6, 8) is used to transfer force on trigger 115 to the original firearm trigger.

It should be noted that the same reference numerals are used in different figures for same or similar elements. It should also be understood that the terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps, and do not supply a serial or numerical limitation on the elements or steps of the embodiments thereof. For example, "first," "second," and "third" elements or steps need not necessarily appear in that order, and the embodiments thereof need not necessarily be limited to three elements or steps. It should also be understood that, unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. It should also be understood that the singular forms of "a," "an," and "the" include plural references unless the context clearly dictates otherwise.

In FIG. 2, a left perspective view of assembly 100 is shown. In FIG. 3, a right perspective view of assembly 100 is shown. Assembly 100 comprises a pair of halves 120 and 121 that are connected together with a series of fasteners such as but not limited to bolts and nuts (see FIG. 6). The fasteners extend through openings 207, 208, and 209 in half 121, and through openings 307, 308, and 309 in half 120. The openings 207 and 307 are aligned when the halves 120 and 121 are aligned. The openings 208 and 308 are aligned when the halves 120 and 121 are aligned. The openings 209 and 309 are aligned when the halves 120 and 121 are aligned. Takedown pin openings 212 and 312 are used to accommodate traditional takedown pins 112 to allow the assembly 100 to be separated, along with lower receiver 5, from upper receiver 6, with mounting block 117 remaining with upper receiver 6 during takedown. Takedown pins 112 operate in known fashion. Magazine well 122 allows a magazine such as magazine 4 to pass through the assembly 100 to seat in the firearm 1.

Figure 4:
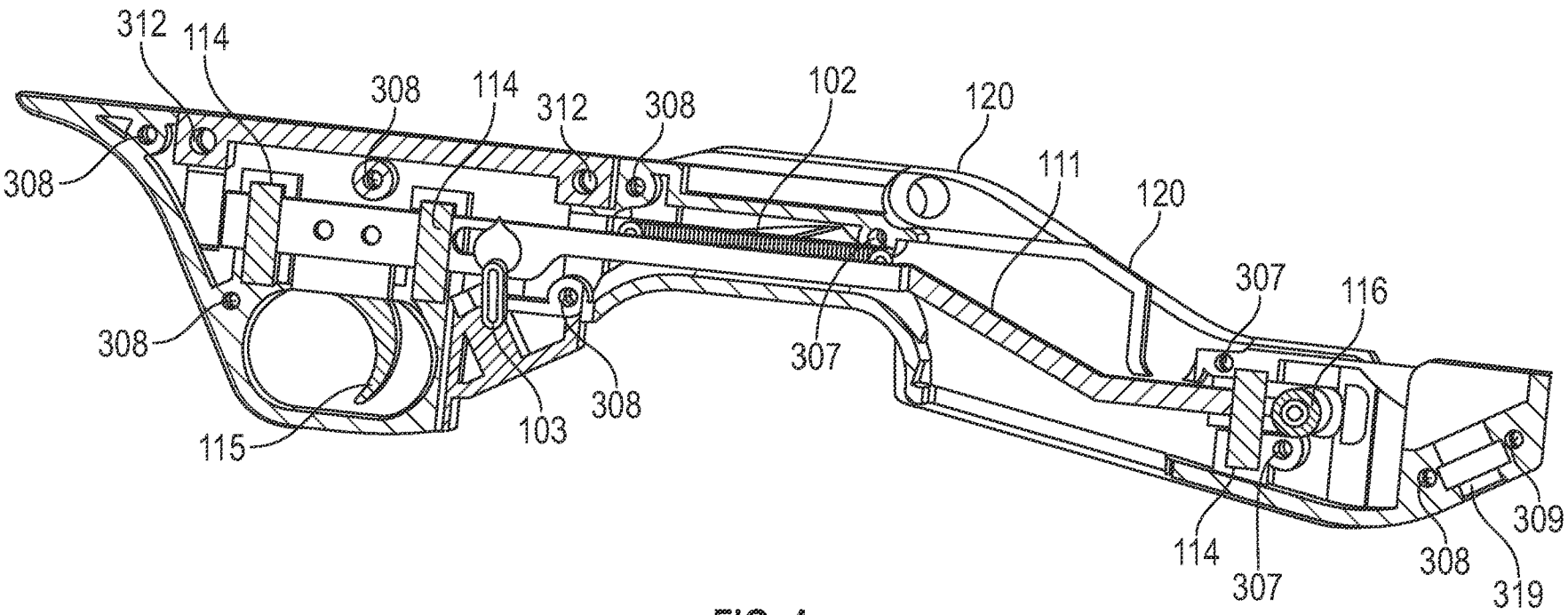
FIG. 4 is a perspective view of a right half of the trigger relocation assembly of FIG. 2.
Figure 5:
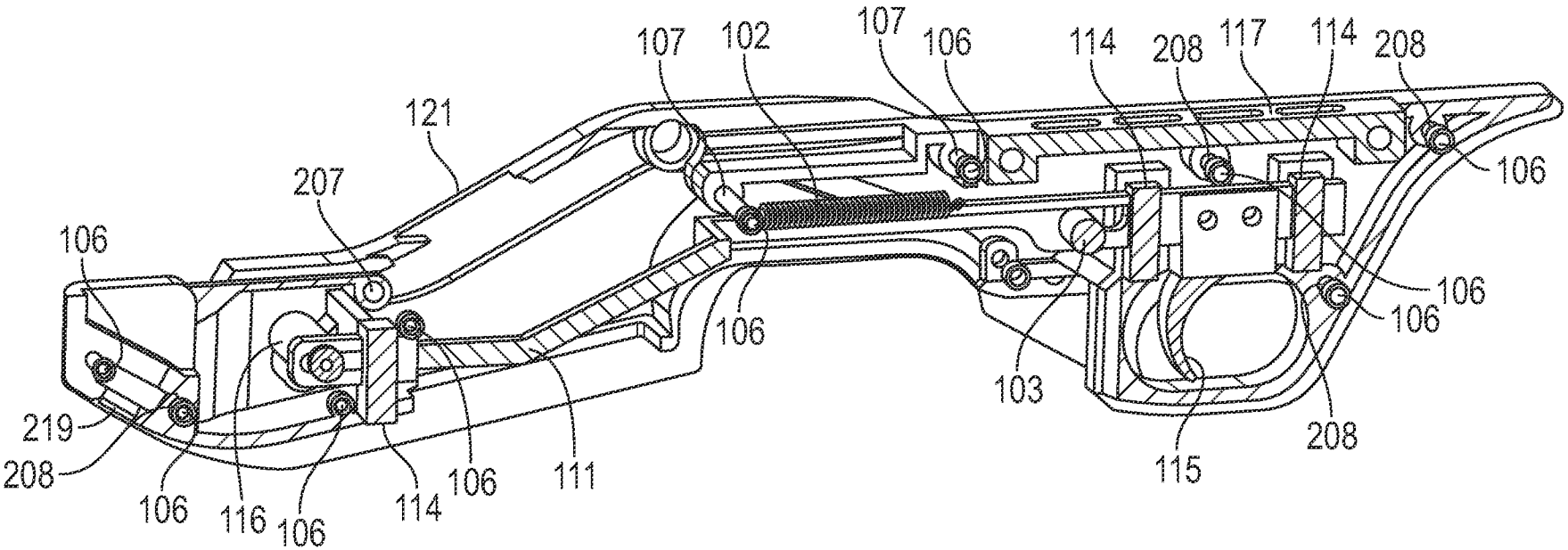
FIG. 5 is a perspective view of a left half of the trigger relocation assembly of FIG. 2.
Figure 6:
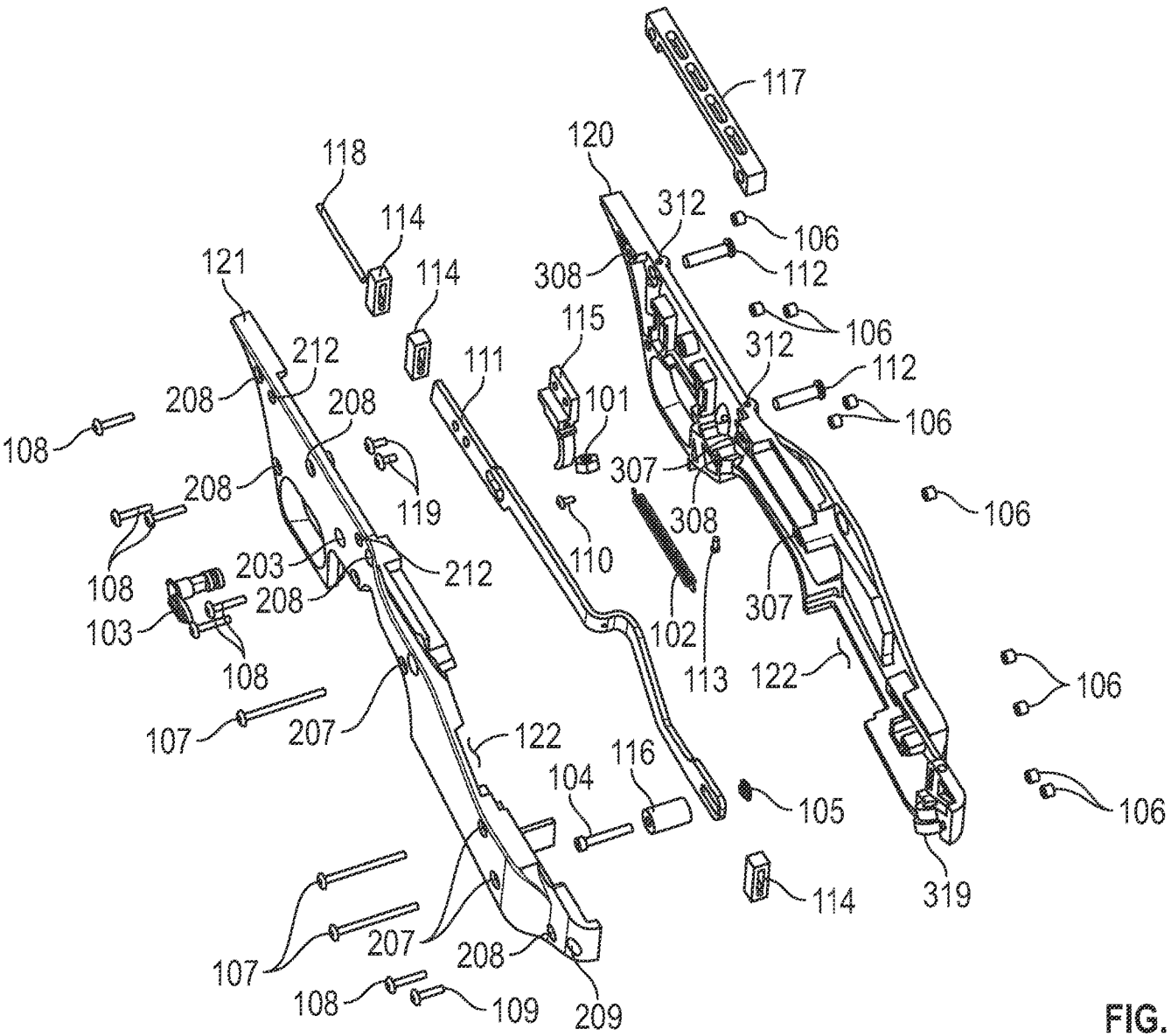
FIG. 6 is an exploded view of the trigger relocation assembly of FIG. 2.

Right half 120 is shown in greater detail in FIG. 4. Left half 121 is shown in greater detail in FIG. 5. Right half 120 includes fastener openings 307, 308, and 309 which correspond to left half 122 fastener openings 207, 208, and 209 when the halves 120 and 121 are joined. Each half contains a safety opening, 203 and 303, respectively, for installation of an ambidextrous safety 103. The safety 103 may be mounted either as a left-hand safety, by mounting the safety 103 as shown in FIGS. 2, 4, and 6, as a right-hand safety, by mounting the safety through opening 303 as shown in FIG. 3, or may be installed with a safety lever on both sides. Half 120 further comprises a half grip bolt opening 319 near a grip location end of the assembly. This corresponds to a half opening 219 in half 120 (see FIG. 5) to form a grip bolt opening that assists, along with takedown pins 112, in securing the assembly 100 to the modern sporting firearm 1. The halves 120 and 121 contain internal components that are shown partially in each of FIGS. 4 and 5, such as spring 102, safety 103, transfer rod 111, bushings 114, trigger 115, trigger actuator 116, mounting block 117, guide rod 118, and associated fasteners such as 104, 105, 110, 113, and 119 for various components as shown in greater detail in FIG. 6.

An exploded view of the trigger relocation assembly 100 is shown in FIG. 1. The trigger relocation assembly 100 comprises in one embodiment a two part frame comprising a first half 120 and a second half 121. The halves 120 and 121 are connectable to each other and the connection is attachable to the modern sporting firearm 1 via a mounting block 117, takedown pins 112, and the screw or bolt opening formed by half openings 219, 319 in each half 121, 120, respectively, corresponding to the location of a grip bolt. The connected frame halves 120 and 121 contain a number of parts for transferring the trigger location of the modern sporting firearm 1 to a more forward position without reducing the length of the barrel 2. A number of mounting bushings 114 are used in the trigger relocation assembly 100 to guide a transfer bar 111 that transfers force applied to a trigger 115 to the original trigger (not shown) of the modern sporting firearm 1. The transfer bar 111 fits into bushings 114, with two such bushings 114 located at the trigger area of the assembly 100, and a third bushing 114 located near the trigger of the original firearm 1. As shown in the exploded view of FIG. 6, as well as the views of FIGS. 2 and 4, the transfer bar 111 imparts a direct one-to-one force of a trigger pull of the trigger 115 to the trigger of the firearm 1. As the transfer bar 111 has mass, such a trigger pull of the trigger 115 may have a higher force used that the force used for the original trigger. To compensate for this, in one embodiment, spring 102 is coupled between the transfer bar 111 and the frame to reduce the trigger pull of the trigger 115 to approximately that of the original trigger pull for the firearm 1. This is accomplished in one embodiment by biasing the trigger 115 toward the forward end of the firearm 1.

Figure 7:
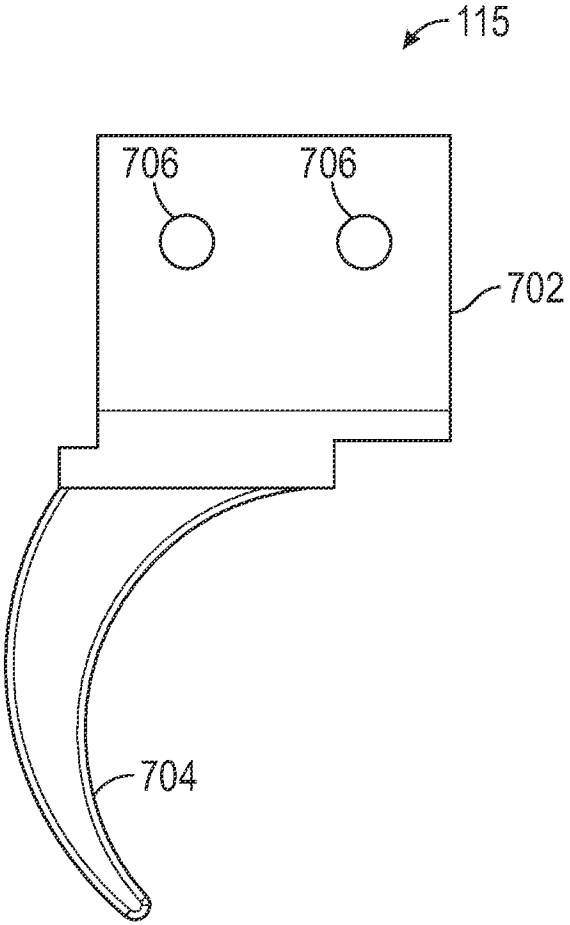
FIG. 7 is a side elevation view of a trigger according to an embodiment of the present disclosure.

A representative trigger 115 is shown in side elevation in FIG. 7. Trigger 115 mounts to transfer bar 111 with mounting openings 706 in main body 702. Trigger pull 704 extends from body 702.

Figure 8:
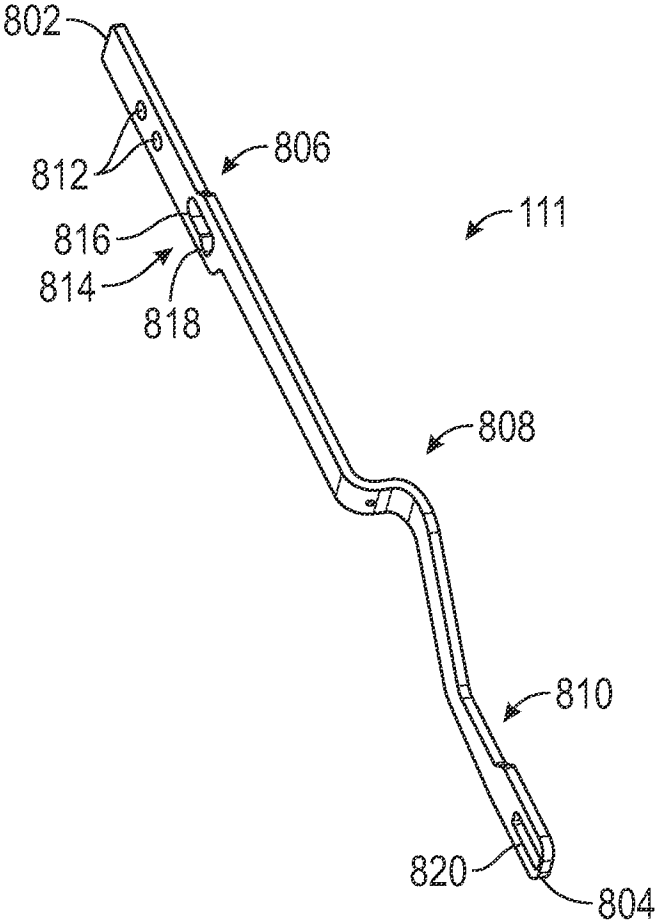
FIG. 8 is a perspective view of a transfer bar according to an embodiment of the present disclosure.

A representative transfer bar 111 is shown in perspective view in FIG. 8. The position of transfer bar 111 in FIG. 8 approximates that of its position as shown in FIG. 6. Transfer bar 111 comprises in one embodiment a first end 802 and an opposite second end 804. End 802 is the trigger end for trigger 115 of the assembly 100. End 804 is the end for the original trigger of firearm 1. The geometry of the transfer bar 111 is configured to provide a single transfer element from trigger 115 to the original firearm trigger. The geometry of the transfer bar 111 allows it to be a single bar, that is contained within the frame of the assembly 100 while being positioned to move and operate around the magazine well and other components of the firearm 1. In this embodiment, three segments between end 802 and end 804 comprises a trigger segment 806, a magazine well segment 808, and an original trigger segment 810.

Segment 806 contains openings 812 for the attachment of transfer bar 111 to trigger 115, for example using screws 119 (FIG. 6). Segment 806 further comprises opening 814 for accommodation of safety 103. Opening 814 is designed to allow rotation of the safety 103 (a standard modern sporting firearm lever based safety in one embodiment) to engage opening portion 818 to safe the firearm against a trigger pull, and to be rotated within opening 814 to opening portion 816 to allow a trigger pull of the trigger 115. Segment 808 is configured to extend around the magazine well 122 of the assembly 100, for accommodation of a magazine such as magazine 4 through the assembly 100 and into the firearm 1. Segment 810 includes opening 820 for connection to trigger actuator wheel 116, which engages the original trigger of the firearm 1. Connection of the trigger actuator wheel 116 to the transfer bar 111 uses in one embodiment screw 104 and nut 105. Opening 820 is elongated in the front-to-back direction to allow proper location of the trigger actuator wheel 116 against the original trigger of the firearm 1, since trigger configurations, sizes, and the like may differ between similar firearms. The trigger wheel actuator is adjusted by placing the trigger actuator wheel 116 into close proximity to the original trigger, loosening screw 104 to adjust the position finely within opening 820, then tightening the screw 104.

Spring 102, as mentioned above, is coupled between the transfer bar 111 and the frame of the assembly 100 to bias the trigger 115 forward, that is, against activation of the firing of a round. This bias is applied by the spring 102, connected between frame half 120 and section 808 (see below) of the transfer bar 111, to ensure a significant force is required to be applied from the rear of the sporting rifle prior to allowing movement of the trigger and other components capable of motion within the assembly 100. Compared to purpose built bullpup firearms, the trigger weight of the present embodiments is reduced, while still providing protection against an accidental discharge when the firearm 1 is dropped. Trigger weight of the present embodiment over purpose built bullpup firearms, may be as low as one third of the purpose built trigger weight. That is, typical trigger weight of purpose built bullpup firearms is on the order of three times the trigger weight of the present embodiments. The spring load may be adjusted to address different trigger pull weights and for different triggers. The spring 102 allows for the assembly 100 to provide a trigger weight more closely aligned with the trigger weight of an unmodified original firearm 1, while still allowing a one-to-one correspondence between a pull of the trigger 115 and the original trigger.

Transfer bar 111 may comprise aluminum or steel, or other materials that provide a suitable stiffness not to bend under the pressure of a trigger pull. The transfer bar 111 may be machined, stamped, formed, or the like without departing from the scope of the disclosure.

Figure 9:
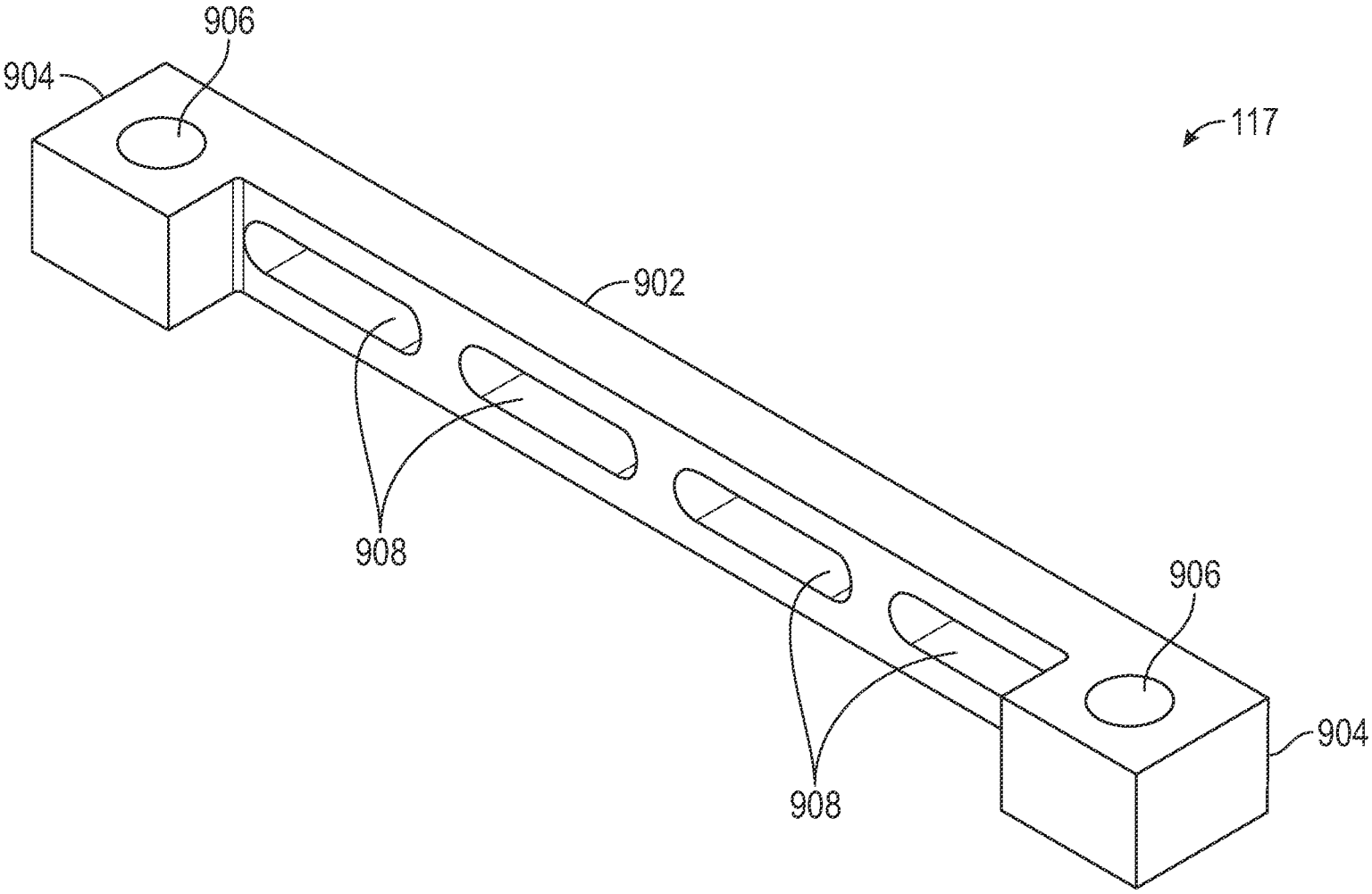
FIG. 9 is a perspective view of a mounting block according to an embodiment of the present disclosure.
Figure 10:
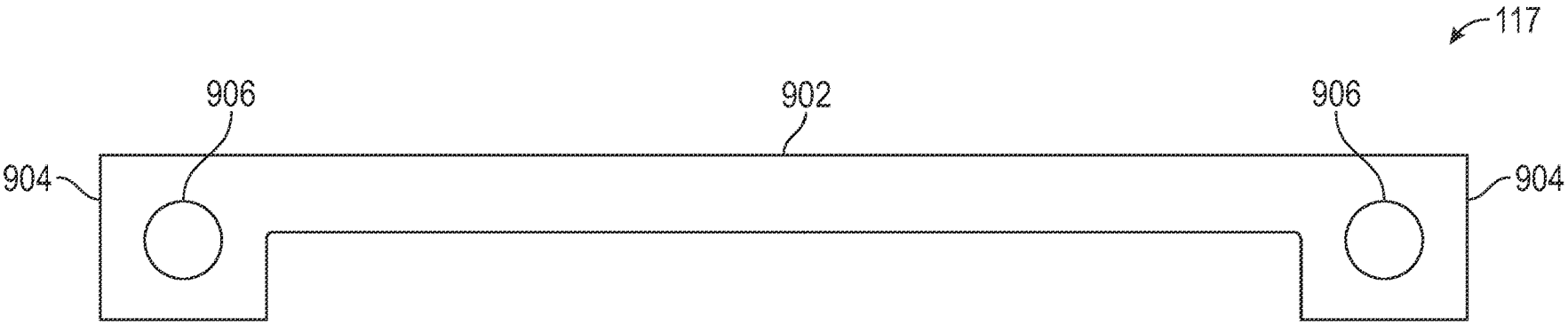
FIG. 10 is a side elevation view of the mounting block of FIG. 9.
Figure 11:
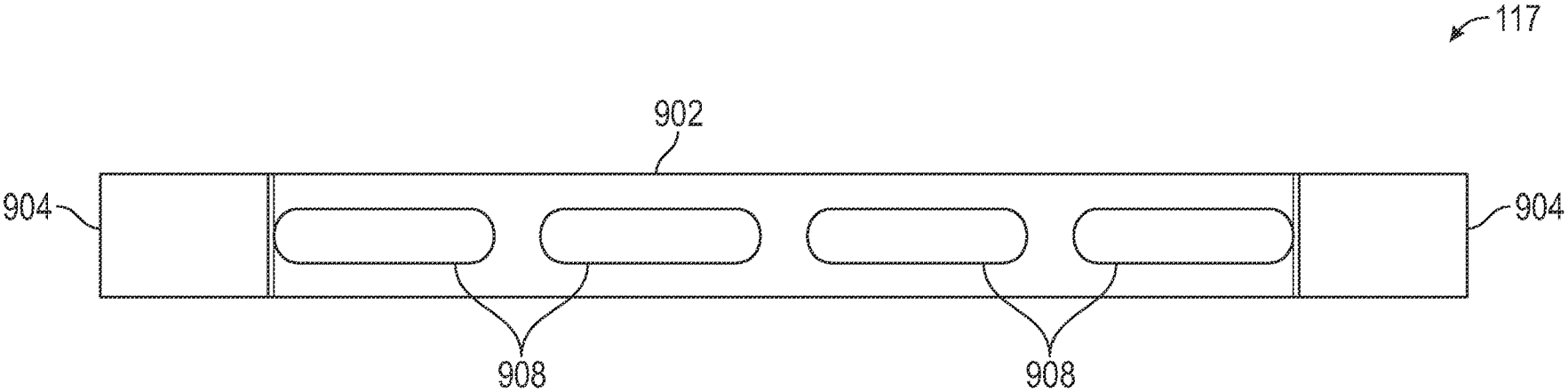
FIG. 11 is a bottom elevation view of the mounting clock of FIG. 9.

A representative mounting block 117 is shown in perspective in FIG. 9, side elevation in FIG. 10, and bottom elevation in FIG. 11. Mounting block 117 is configured in one embodiment to mount to an upper receiver 6 of a modern sporting firearm 1, in one embodiment using what is referred to as a key lock configuration. This is a standard mounting process using commercially available components and is not further described herein. Mounting block 117, once mounted to upper receiver 6 of firearm 1, fits into the frame between the two halves 120 and 121 as shown in FIGS. 2-5. Mounting bar 117 comprises in one embodiment a center body 902 and two end blocks 904, an end block 904 at each opposite end of the center body 902. Center body 902 comprises a plurality of openings 908 for mounting the mounting block 117 to a keymod rail or other commercially available assemblies in known fashion. However, it should be understood that other mounting systems such as m-lok or picatinny systems may be used without departing from the scope of the disclosure, provided the mounting block 117 is adjusted to accommodate such other systems. Openings 906 are sized to accommodate takedown pins 112 to lock the assembly 100 at the mounting block 117 to the upper receiver 6. Removal of the takedown pins allows the upper receiver 6 and the lower receiver 5 to be separated, with the mounting block remaining with the upper receiver 6 and the rest of assembly 100 remaining with the lower receiver 5.

Figure 13:
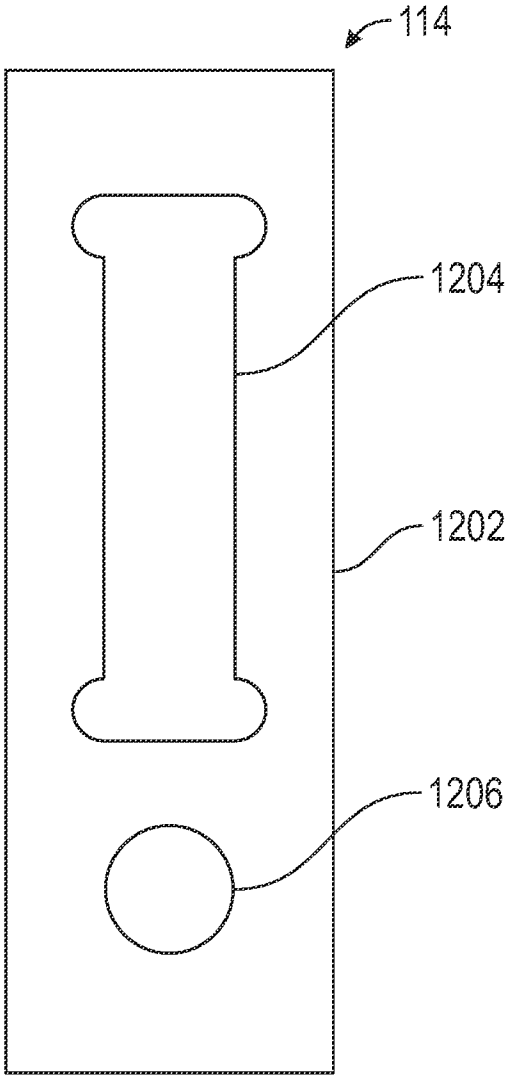
FIG. 13 is a front elevation view of the bushing of FIG. 12.
Figure 12:
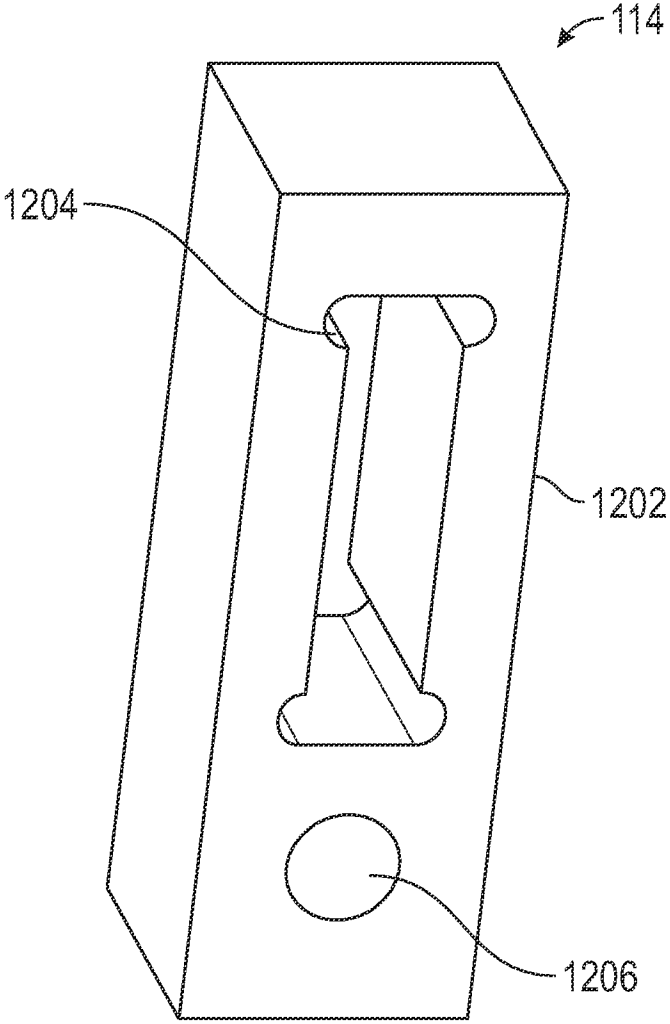
FIG. 12 is a perspective view of a bushing according to an embodiment of the present disclosure.

A representative bushing 114 is shown in perspective view in FIG. 12, and in front elevation view in FIG. 13. Bushing 114 comprises in one embodiment a main body 1202 having openings 1204 and 1206. Opening 1204 is sized to accommodate transfer bar 111. Opening 1206 is sized to accommodate a guide rod 118 (see FIG. 6). Three bushings 114 are provided in one embodiment of assembly 100. The bushings 114 provide a seat and guidance for the transfer bar 111 within the assembly 100. As shown best in FIGS. 4 and 5, trigger 115 is mounted to transfer bar 111, and the trigger location in segment 806 is positioned between two bushings 114. The transfer bar 111 slides into opening 1204 of each bushing. A third bushing 114 is positioned near end 804 of transfer bar 111, rearward of opening 820 thereof. Bushings 114 can be integrated into the components and are shown in this embodiment for ease of assembly and preventing tolerance buildup.

The bushings 114 act as slide bearings for the transfer bar 111, and are mounted within the frame of the assembly 100. The bushings 114 allow front to back movement of the transfer bar 111, but not side to side or top to bottom movement. In this fashion, the transfer bar 111 prevents trigger rotation from side to side or top to bottom, leading to a smooth trigger pull forward to rearward. Such a configuration may improve accuracy due to the guided travel of the transfer bar 111 within the bushings 114. That is, there are no side pulls, no pressing side to side, and the like, which can lead to reduced accuracy in shooting. The bushings are in one embodiment low friction bushings that do not add significantly to trigger pull weight. Further, the spring bias provided by spring 102 may be adjusted to account for friction from the bushings 114 or per user preference after taking safety considerations into account.

The embodiments of the present disclosure provide a trigger relocation mechanism that does not change the original configuration of a modern sporting rifle. The embodiments of the present disclosure allow installation on existing geometries without modifying or removing the existing trigger. Further, the safety mechanism of the embodiments of the present disclosure replicate the position and function of a traditional modern sporting firearm safety.

The above-disclosed subject matter is to be considered illustrative, and not restrictive, and the appended claims are intended to cover all such modifications, enhancements, and other embodiments, which fall within the true scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A trigger relocation assembly for a modern sporting firearm, comprising:

a frame enclosing a trigger of the modern sporting firearm;

an assembly trigger within the frame, the assembly trigger positioned forward of the trigger;

an asymmetrical transfer bar coupled to transfer movement of the assembly trigger one-to-one to the trigger; and a plurality of bushings, the bushings configured to guide the transfer bar within the frame;

wherein the frame comprises:

a first half and a second half, the first half and the second half containing the assembly trigger, the asymmetrical transfer bar, and the plurality of bushings; and a plurality of fasteners to fasten the first half and the second half to each other, and to the modern sporting firearm.

2. The trigger relocation assembly of claim 1, and further comprising a mounting block configured to mount to a mounting system of the modern sporting firearm and to allow removable mounting of the assembly to the mounting block and the modern sporting firearm.

3. The trigger relocation assembly of claim 2, and further comprising a spring coupled between the frame and the asymmetrical transfer bar, the spring configured to bias the asymmetrical transfer bar against a direction of trigger pull of the assembly trigger.

4. The trigger relocation assembly of claim 1, wherein the transfer bar is coupled between the assembly trigger and the trigger, and is configured to wrap around a magazine well of the frame on a single side thereof.

5. The trigger relocation assembly of claim 1, and further comprising a safety mechanism for the assembly trigger, the safety mechanism configured to engage the transfer bar to stop rearward motion of the assembly trigger when engaged.

6. A modular assembly for a modern sporting firearm, comprising:

a trigger relocation assembly removably attachable to the modern sporting firearm without functional alteration of the modern sporting firearm; the trigger relocation assembly comprising:

a frame enclosing a trigger of the modern sporting firearm;

an assembly trigger within the frame, the assembly trigger positioned forward of the trigger;

an asymmetrical transfer bar coupled to transfer movement of the assembly trigger one-to-one to the trigger; and a safety mechanism for the assembly trigger, the safety mechanism configured to engage the transfer bar to stop rearward motion of the assembly trigger when engaged.

7. The modular assembly of claim 6, wherein the frame comprises:

a first half and a second half, the first half and the second half containing the assembly trigger, the asymmetrical transfer bar, and the plurality of bushings; and a plurality of fasteners to fasten the first half and the second half to each other, and to the modern sporting firearm.

8. The modular assembly of claim 6, and further comprising a mounting block configured to mount to a mounting system of the modern sporting firearm and to allow removable mounting of the assembly to the mounting block and the modern sporting firearm.

9. The modular assembly of claim 8, and further comprising a spring coupled between the frame and the asymmetrical transfer bar, the spring configured to bias the asymmetrical transfer bar against a direction of trigger pull of the assembly trigger.

10. The modular assembly of claim 6, wherein the transfer bar is coupled between the assembly trigger and the trigger, and is configured to wrap around a magazine well of the frame on a single side thereof.

11. A method of reversibly converting a modern sporting rifle between a standard configuration and a bullpup configuration, comprising:

providing a frame attachable to the modern sporting rifle with a mounting block;

mounting the frame to the mounting block and to the modern sporting rifle;

providing a trigger assembly for the frame using an asymmetrical transfer bar to provide one-to-one correspondence between a trigger of the trigger assembly and a trigger of the modern sporting firearm; and biasing the asymmetrical transfer bar against a direction of trigger pull of the assembly trigger with a spring coupled between the frame and the asymmetrical transfer bar.

12. The method of claim 11, wherein mounting the frame comprises mounting a mounting block to a mounting system of the modern sporting firearm, the mounting block configured to allow removable mounting of the assembly to the mounting block and the modern sporting firearm.

13. The method of claim 11, and further comprising providing a safety mechanism for the assembly trigger, the safety mechanism configured to engage the transfer bar to stop rearward motion of the assembly trigger when engaged.

* * * * *